US005937461A

United States Patent [19]

Dombrowski et al.

[11] Patent Number: 5,937,461

[45] Date of Patent: Aug. 17, 1999

[54] RECONFIGURABLE INFANT SUPPORT

[75] Inventors: David Dombrowski; Brian L. Aiken; Kenneth Von Felten, all of East Aurora, N.Y.

[73] Assignee: Fisher-Price, Inc., East Aurora, N.Y.

[21] Appl. No.: 08/912,165

[22] Filed: Aug. 15, 1997

[51] Int. Cl.[6] ..... A47C 20/02

[52] U.S. Cl. ..... 5/655; 5/632; 5/657

[58] Field of Search ..... 5/630, 632, 633, 5/640, 643, 648, 652, 653, 655.9, 655, 657, 657.5

[56] References Cited

U.S. PATENT DOCUMENTS

| | | | |
|---|---|---|---|
| D. 300,694 | 4/1989 | Krok . | |
| D. 389,359 | 1/1998 | Nowak . | |
| 1,695,263 | 7/1928 | Jacques . | |
| 3,289,224 | 12/1966 | Witchel . | |
| 3,813,148 | 5/1974 | Krauss . | |
| 4,434,513 | 3/1984 | Welch . | |
| 4,783,865 | 11/1988 | Stotler . | |
| 4,802,244 | 2/1989 | McGrath-Saleh . | |
| 4,972,532 | 11/1990 | Juan . | |
| 5,056,533 | 10/1991 | Solano | 5/655 |
| 5,148,564 | 9/1992 | Reder . | |
| 5,265,292 | 11/1993 | Underell | 5/419 |
| 5,310,245 | 5/1994 | Lyszczasz | 5/655 X |
| 5,367,730 | 11/1994 | Sher | 5/655 |
| 5,371,909 | 12/1994 | McCarty . | |
| 5,383,711 | 1/1995 | Houghteling . | |
| 5,450,640 | 9/1995 | Patton et al. | 5/655 |
| 5,457,832 | 10/1995 | Tatum . | |
| 5,499,418 | 3/1996 | Tan et al. . | |
| 5,524,640 | 6/1996 | Lisak et al. . | |
| 5,528,783 | 6/1996 | Kunz et al. . | |
| 5,528,785 | 6/1996 | Petrus . | |
| 5,535,467 | 7/1996 | Ciske . | |
| 5,546,619 | 8/1996 | Braun . | |
| 5,546,620 | 8/1996 | Mathews . | |
| 5,551,108 | 9/1996 | Butler, III . | |
| 5,561,879 | 10/1996 | Everall . | |
| 5,570,703 | 11/1996 | Cooper . | |
| 5,572,757 | 11/1996 | O'Sullivan . | |
| 5,581,832 | 12/1996 | Bridley | 5/655 |
| 5,586,351 | 12/1996 | Ive . | |
| 5,669,665 | 9/1997 | Nowak . | |
| 5,829,829 | 11/1998 | Celestina-Krevh . | |

FOREIGN PATENT DOCUMENTS

| | | | |
|---|---|---|---|
| 167063 | 6/1985 | European Pat. Off. . | |
| 1098836 | 5/1955 | France . | |
| 4237792 A1 | 5/1993 | Germany | A47G 9/00 |
| 129812 | 7/1919 | United Kingdom . | |
| 1560299 | 12/1976 | United Kingdom . | |

*Primary Examiner*—Michael F. Trettel
*Attorney, Agent, or Firm*—Morgan, Lewis & Bockius, LLP; C. Scott Talbot; James L. Reed

[57] ABSTRACT

A reconfigurable support for an infant includes a main body and two reconfigurable restraints or support members mounted to opposite ends of the main body. The infant support can be used to securely position an infant that is either lying prone on a flat surface or that is seated in a child's seat, such as a car seat.

The first configurable support member is formed as a cylindrical cushion and contains a bendable element that can be configured into a variety of shapes. The first support member retains the shape into which it is configured and thus can be configured and positioned to securely position an infant.

A second reconfigurable support member is provided at the opposite end of the main body. The second member is integrally formed with the main body and includes two or three planar members. The planar members are reconfigurable such that they can either be configured to form a wedge shape projecting above the upper surface of the main body to support a lying infant or to lie coplanar within the main body so that the main body may be used as a seat lining.

40 Claims, 14 Drawing Sheets

RECONFIGURABLE INFANT SUPPORT

BACKGROUND OF THE INVENTION

The invention relates to infant supports that position an infant. More specifically, the invention relates to an infant support that is capable of supporting a child while the child is in either a lying or a seated position.

A variety of infant support apparatuses are known that enable an infant to be securely positioned.

U.S. Pat. No. 5,371,909 to McCarty discloses a cylindrical cushion that contains a bendable rod that is enclosed within it. The cushion is able to be formed into various configurations for supporting an infant by altering the shape of the rod within it.

U.S. Pat. No. 5,499,418 to Tan et al. Discloses two opposed supports with a flexible sheet disposed between the supports. A child who is placed on the sheet is constrained from moving outside of a region defined by the two opposed supports. The supports may be formed of various shapes and may be filled with various materials to enable the supports to adapt to the shape and/or size of an infant. One of the support is releasable fastened to the flexible sheet.

U.S. Pat. No. 5,528,785 to Petrus discloses a confining device for an infant that converts a seat cushion of a couch into a confining device for a resting infant. The confining device includes a sheet for covering the portion of the seat cushion where the baby is resting. A wedge is positioned along a perimeter of the sheet in order to provide a barrier so that the baby does not fall onto the floor.

A variety of flexible head or neck supports are known which can be disposed about an infant's head or neck while the infant is seated in a seat or car seat. One such known support includes a fabric liner extending from the head support that is intended to be disposed beneath the infant while the infant is seated in the seat.

None of these known devices can be used to securely position an infant both while lying prone on a flat surface and while seated in a seating apparatus. The '909 patent discloses a single, bendable support cushion. Since the apparatus of the '909 patent only consists of a single support, the apparatus does not conveniently provide for securely positioning an infant within opposing sidewalls while still allowing for adequate space for caring for the infant, e.g. changing the baby's diaper.

The '418 patent provides for securely positioning a lying infant between two opposing bolsters, however, the apparatus is not able to be used for positioning a seated infant. The bolsters are not able to be reconfigured, without removing one of the bolsters, such that they can be appropriately formed to support an infant seated on a child's seat. The support apparatus of the '785 patent also suffers from the drawback that it cannot be reconfigured to support a seated infant.

Therefore, it would be desirable to provide an infant support cushion that can be configured to securely position an infant that is either lying prone on a flat surface or that is seated in an infant seat without requiring removal of any of the support members of the apparatus.

SUMMARY OF THE INVENTION

The drawbacks of the infant support apparatuses in the prior art are overcome by the present invention, which includes two reconfigurable support members that are formed with a cushioned infant support surface. The support apparatus is able to securely position an infant that is either lying prone on a flat surface or that is seated in a child's seat, such as a car seat.

A first reconfigurable support member is formed as a cylindrical cushion. The first member contains a bendable material that can be configured into a variety of different shapes. The first member is able to retain the shape that it is configured into and is thus able to be configured and positioned to securely position an infant. The first member is attached to the cushioned infant support surface at a first end of the support surface. A second reconfigurable support member is provided at a second end of the cushioned infant support surface. The second member is integrally formed with the support surface and is comprised of two or three planar members. The three planar members are reconfigurable such that they can be reconfigured as either a wedge shape to support a lying infant or be configured to be coplanar with the support surface. In the coplanar configuration, the second reconfigurable support member is indistinguishable within the support surface and allows the support surface to be utilized as a lining for a child's seating apparatus, such as the car seat mentioned above.

DETAILED DESCRIPTION

Figure 1:
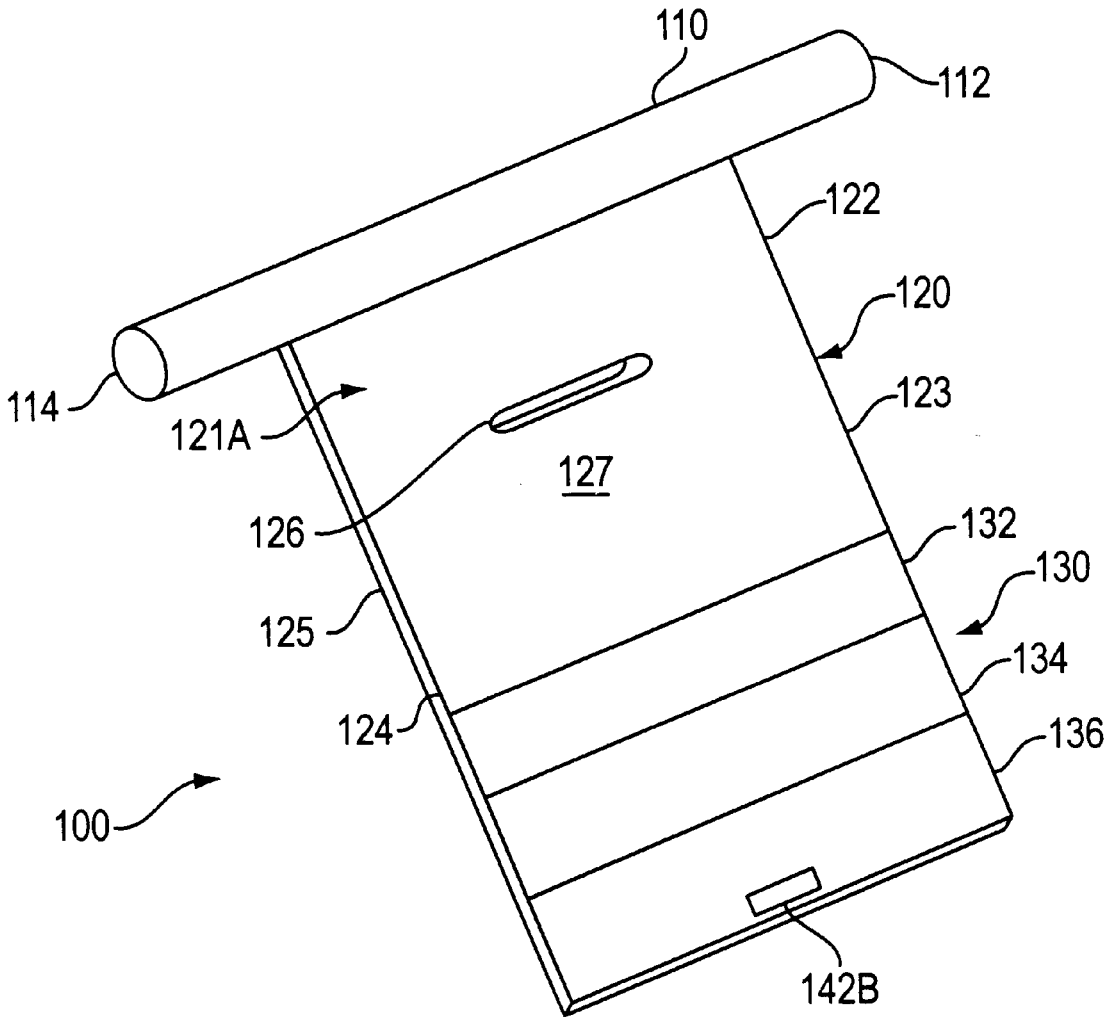
FIG. 1 is a perspective view of a first embodiment of a reconfigurable infant support.
Figure 2A:
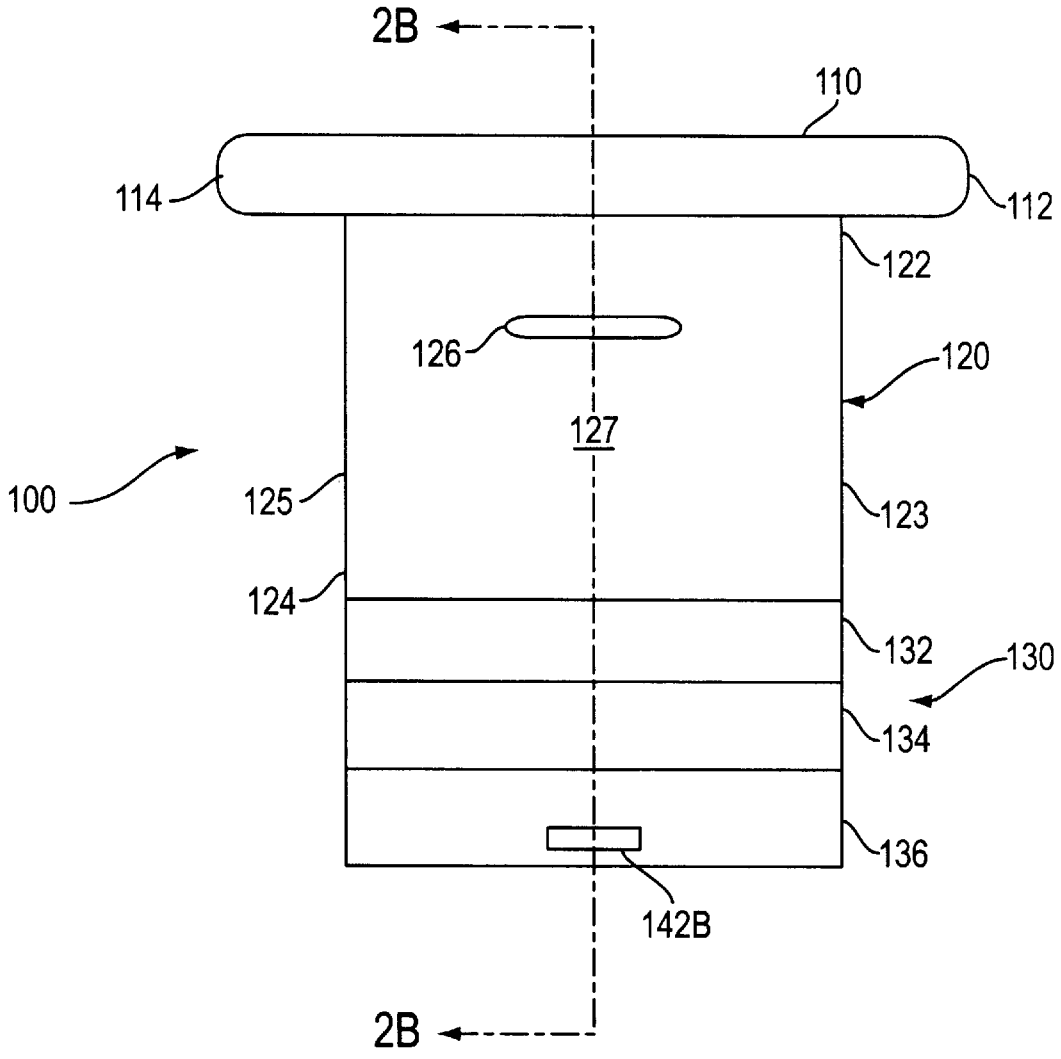
FIG. 2A is a top view of the infant support of FIG. 1.

As illustrated in FIGS. 1 and 2A, the reconfigurable infant support 100 includes a first reconfigurable support member or restraining member 110, a body 120, and a second reconfigurable support member or restraint 130. First reconfigurable support member 110 is attached to body 120 at its first end 122 and second reconfigurable support member 130 is attached to body 120 at its second end 124.

Body 120 is generally planar and rectangular, with an upper support surface 121A, a lower surface 121B, and left and right lateral edges 123, 125. Body 120 is formed of quilted fabric.

First reconfigurable support member 110 is formed to be generally cylindrically-shaped. Support member 110 is fixedly attached to body 120 at a first end 122 of body 120. The support member may be attached by means such as stitching or may be integrally formed with body 120 by an extension of the same fabric that is utilized to form the body. As such, support member 110 is permanently affixed to body 120.

Ends 112 and 114 of support member 110 extend beyond the lateral edges 123, 125 of body 120. It is preferred, but not required, that ends 112 and 114 extend beyond the lateral edges of body 120. The extension of ends 112 and 114 allow for ease configuring support member 110 into any number of shapes and positions since the entire length of the support member is not constrained by attachment to body 120.

Figure 2B:
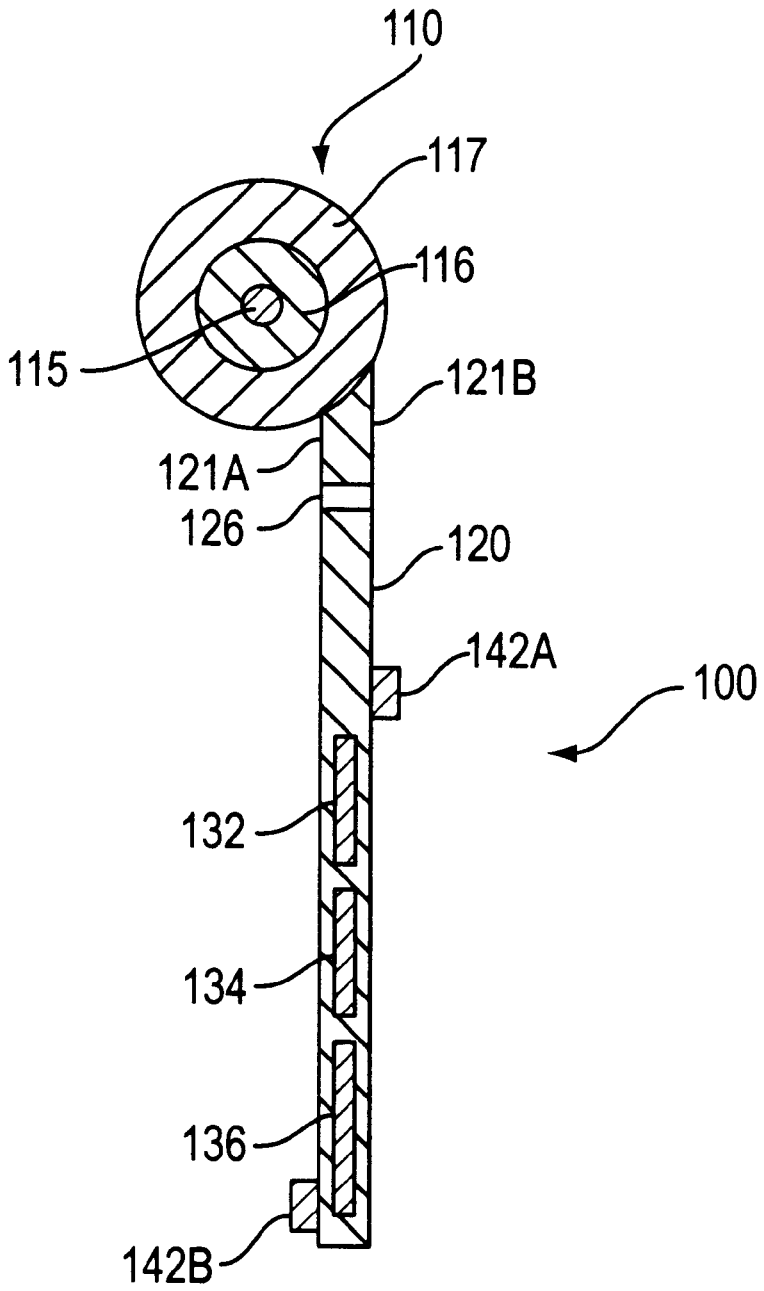
FIG. 2B is a cross-sectional view of the infant support taken along the line 2B—2B of FIG. 2A.

FIG. 2B shows a cross-sectional view of reconfigurable infant support 100. As can be seen, support member 110 includes an internal, elongated, bendable element 115, element 115 may be comprised of any material that has the characteristics of being easily reconfigurable by a person and being able to retain its configuration after manipulation by the person. In the presently preferred embodiment, element 115 is a malleable metal wire. Alternatively, element 115 could be formed of a series of flexible connection joints, such as disclosed in U.S. Pat. No. 5,449,206 to Lockwood. Additionally, element 115 may be positioned centrally within, and along the longitudinal axis of, support member 110 or be positioned off-center within support member 110. Bendable element 115 may extend along the entire length of support member 110 or consist of two separate elements that are positioned within ends 112 and 114 of support member 110.

Bendable element 115 is encased within cushion 116. Cushion 116 provides for a soft medium between the outer fabric of support member 110 and bendable element 115 to comfortably and safely support a child that is positioned within the reconfigurable infant support. Cushion 116 may be comprised of foam rubber, fabric padding material or any number of alternatives that can provide for a soft medium between a child and the bendable element. Additional cushioning material or shaping material 117 may be contained within support member 110 to provide for further comfort and/or safety of the child user, however, it is not required.

Body 120 is attached to first support member 110 at a first end 122. When infant support 100 is utilized to position an infant that is lying prone, the infant is placed on body 120 in child receiving area 127. When positioned in area 127, the infant can be securely positioned on the body with first support member 110 supporting the infant on one side and second support member 130, which will be discussed in detail below, supporting the infant on the opposing side. Body 120 may be cushioned to provide for comfort for the infant.

When infant support 100 is utilized to support an infant that is seated in a child seat, body 120 serves as a lining for the seat. Aperture 126 is provided in body 120 so that when the infant support is utilized as a car seat lining, the shoulder belts of the car seat may extend through aperture 126 to be positioned over the shoulders of the child occupant to secure the occupant to the car seat.

Second reconfigurable support member 130 is integrally formed with body 120 at a second end 124 of body 120. Second support member 130 is comprised of three similarly formed, individually positioned, planar members 132, 134, and 136. Planar members 132, 134, and 136 are rectangular in shape, relatively rigid, and are formed of polypropelene sheet. First planar member 132 is disposed proximal to second end 124 of body 120, second planar member 136 is disposed distal from second end 124 of body 120, and third planar member 134 is disposed between first member 132 and second member 136. The planar members have a width dimension that is slightly smaller than the width of body 120 and a thickness that is commensurate with the thickness of body 120. In the illustrated embodiment, the planar members have a nominal thickness of 0.08 inches ( 4 mm). As such, the planar members are able to be securely positioned within body 120. The planar members are positioned side-by-side within body 120 as can be seen in FIG. 2B.

Figure 3:
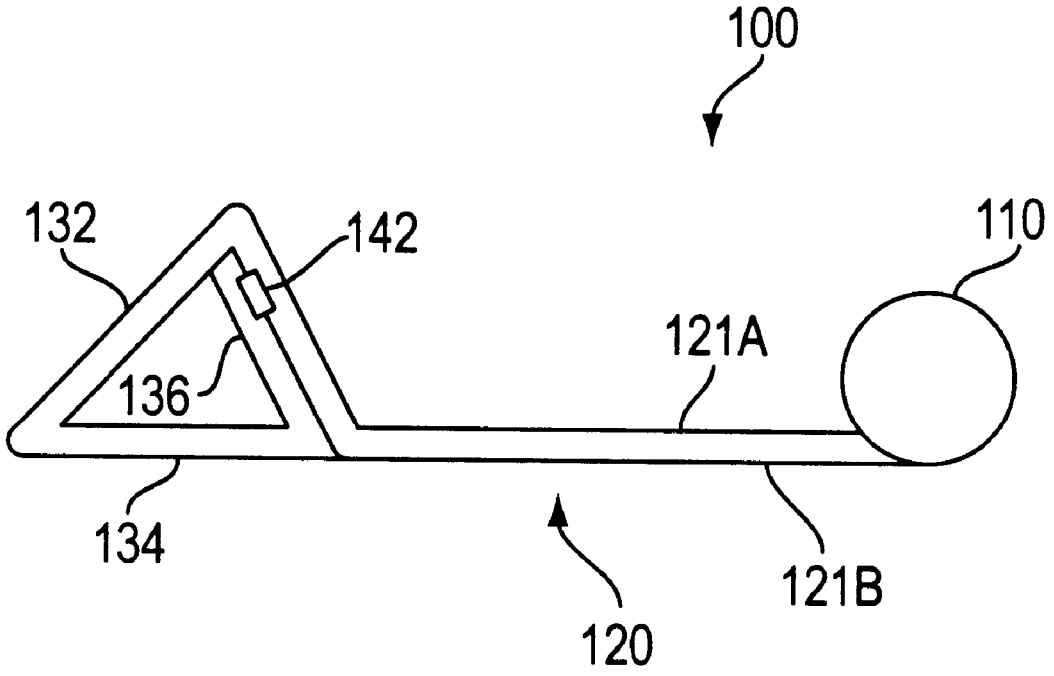
FIG. 3 is a side view of the infant support with the second support member in a wedge shape configuration.
Figure 4:
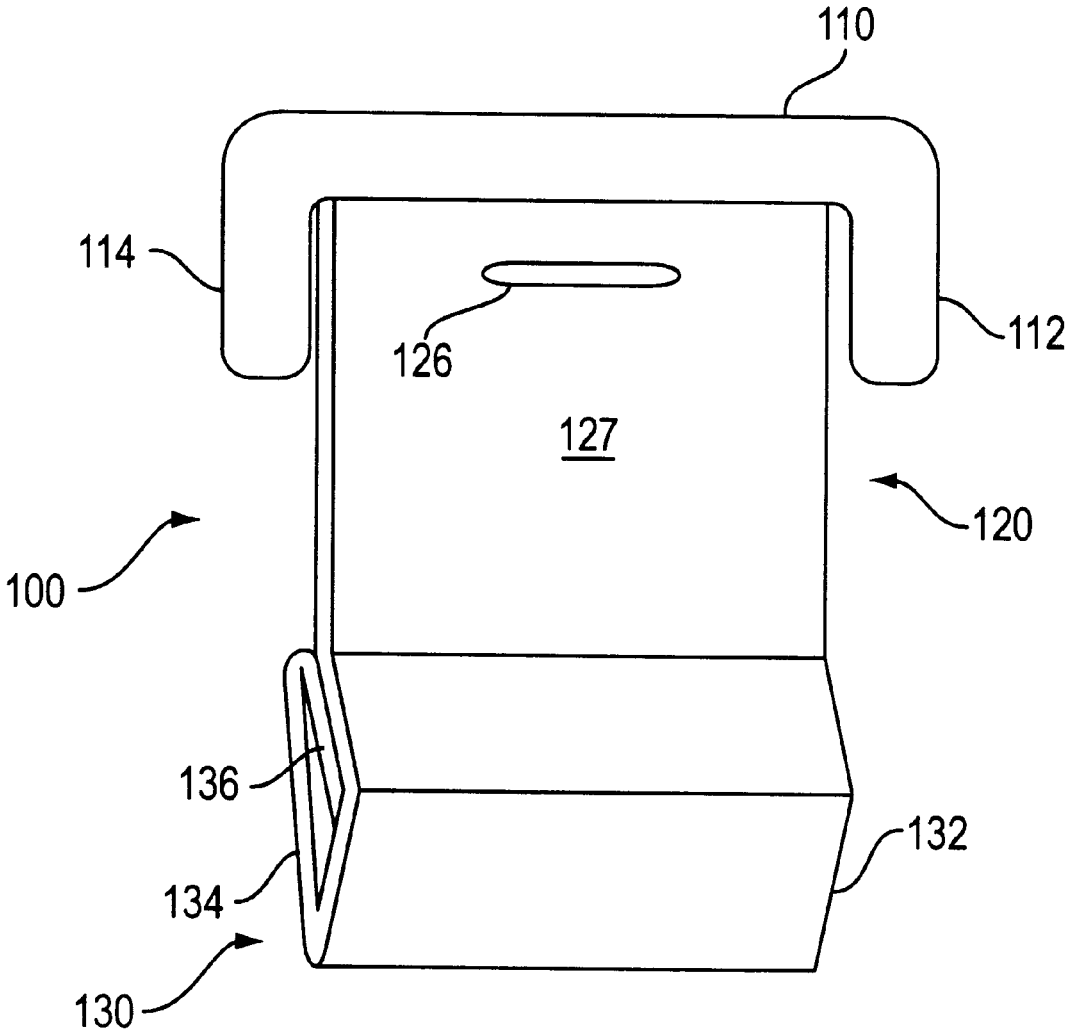
FIG. 4 is a perspective view of the infant support with the second support member in a wedge shape configuration.

When infant support 100 is utilized to support an infant that is lying prone, planar members 132, 134, and 136 are configured by the user into a first, wedge shape configuration as shown in FIGS. 3 and 4. When second reconfigurable support member 130 is formed into the wedge shape, support member 130 extends above the horizontal plane, or upper surface 121A, of body 120. To form the wedge shape, a user folds second planar member 136 and third planar member 134 under body 120. Third planar member 134 serves as the horizontal base of the wedge and first member 132 and second member 136 serve as the angularly positioned sides of the wedge. As shown in FIG. 3, a connector or fastener 142 is provide to maintain the planar members in the wedge shape by securing the wedge to body 120. In the illustrated embodiment, fastener 142 is a hook-and-loop fastener, with first connector portion, or hook portion, 142A mounted on the lower surface 121B of body 120 and second connector portion, or loop portion, 142B mounted on the top of the fabric that encloses second planar member 136. When planar member 136 is folded under body 120 to form the innermost angular side of the wedge shape, the fastener portion associated with planar member 136 will be positioned adjacent the fastener portion associated with the body and the two portions may be mated together to securely position the wedge with the body. Alternatively, fastener 142 could be formed with snaps, buttons, magnets, zippers, or any other known fastener that provides for releasable connection of the wedge to body 120.

When infant support 100 is utilized to position an infant within a child's seat, planar members 132, 134, and 136 of the second reconfigurable support member 130 are configured in a second configuration to lie coplanar with body 120 and substantially flush with upper surface 121A. As such, second reconfigurable support member 130 is indistinguishable from body 120 and allows body 120 to be utilized to line the child's seat without any interference to the child occupant.

Therefore, in operation, reconfigurable infant support 100 may be utilized to securely position an infant that is either lying flat in a prone position on a flat surface or an infant that is seated in a child seating apparatus. FIG. 4 depicts infant support 100 as utilized to support an infant lying prone on a flat surface. As can be seen, first reconfigurable support member 100 is slightly reconfigured at ends 112 and 114 to position these ends closer to the head and feet of a child occupant so that the child is securely positioned on three sides. Second reconfigurable support member 130 is configured in the first, wedge-shaped configuration to securely position the child on the side opposing first reconfigurable support member 100. Therefore, a child occupant can be securely positioned on body 120 in area 127 when first and second reconfigurable support members 110 and 130, respectively, are configured as shown in FIG. 4.

Figure 5A:
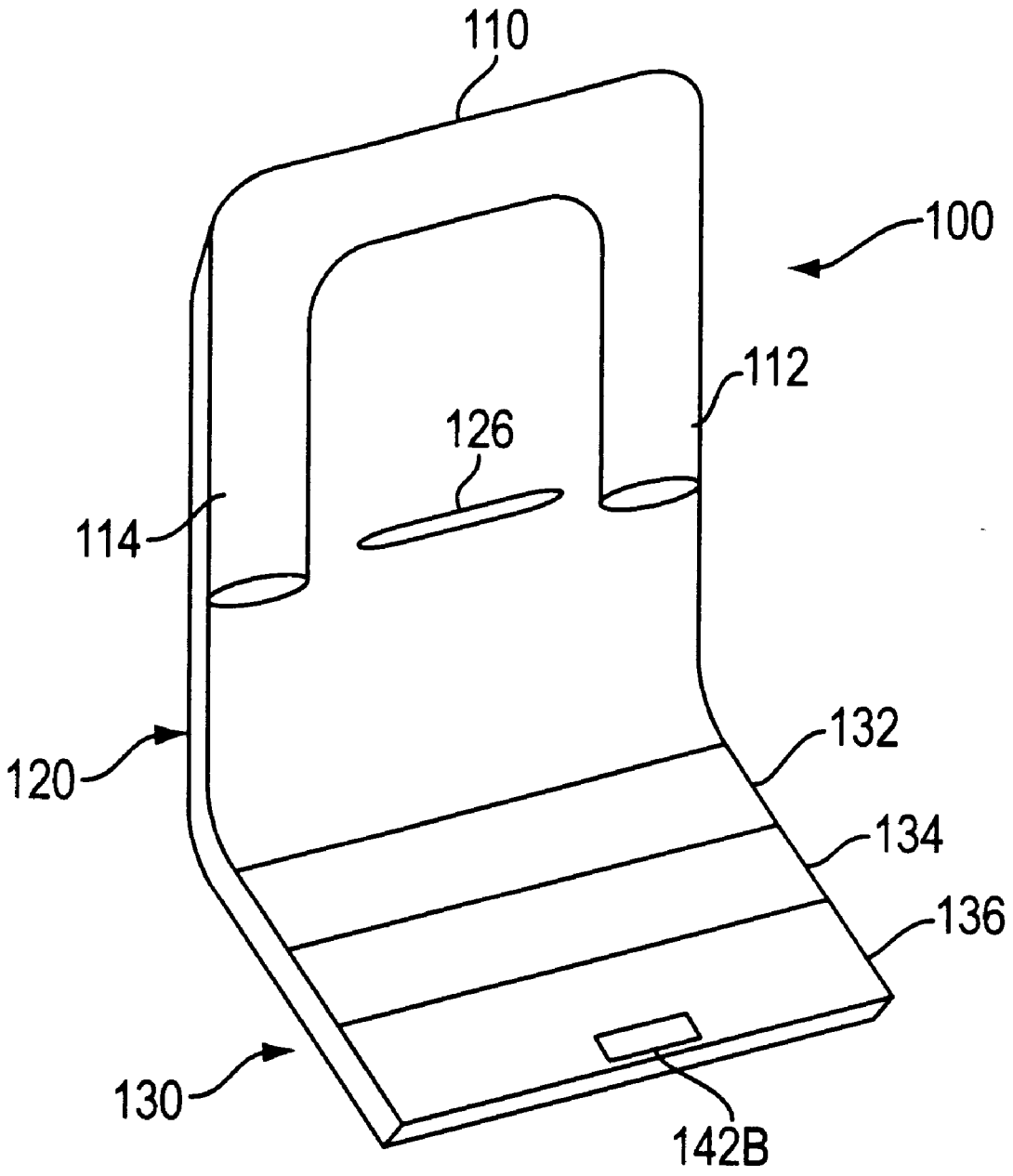
FIG. 5A is a perspective view of the infant support as it would be configured to support a seated infant.
Figure 5B:
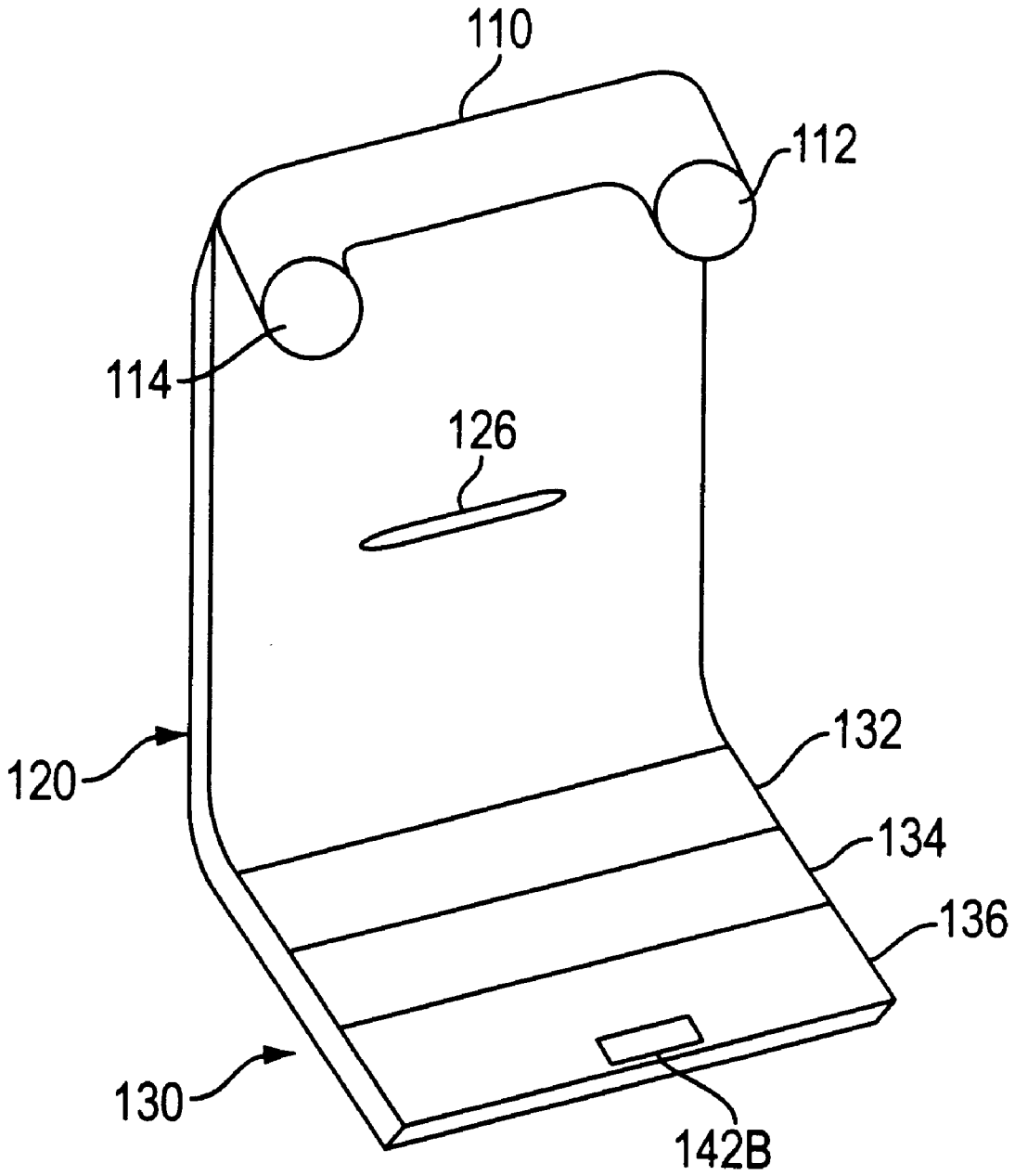
FIG. 5B is a perspective view of the infant support as it would be configured to support a seated child.

FIGS. 5A and 5B show infant support 100 as it would be configured when utilized to support a seated infant. Body 120 is utilized as a lining for the seat and first reconfigurable support member 110 is utilized to support the head of the child occupant. In both figures, second reconfigurable support member 130 is configured to lie coplanar with body 120 and thus be unobtrusive for a child who is seated on body 120.

FIG 5A depicts infant support 100 as it could be positioned to support an infant seated in a child seat. First reconfigurable support member 110 is formed to be positioned around the head of the infant such that the head is supported on all sides. This positioning is desirable for an infant since an infant is usually not able to support its head in an upright position without assistance.

FIG. 5B depicts infant support 100 as it could be positioned to support a more mature child that is seated in the seat. First support member 10 is formed to be positioned around the neck and over the shoulders of the child rather than around the periphery of the head, as was discussed above for an infant. By placing support member 110 around the shoulders and neck of the more mature child, support member 110 provides appropriate positioning support.

In this manner, reconfigurable infant support 100 may be configured to support either a child that is lying prone on a flat surface or a child that is seated in a child's seating apparatus. Support members 110 and 130 are easily reconfigurable to support a child in either of these positions.

Several variations on the disclosed first embodiment are contemplated. For example, in the disclosed embodiment, support members 110, 130 and body 120 are all covered with cloth fabric material, however, water resistant materials, e.g. plastic, could be utilized to provide for ease in caring for and cleaning the cover. Additionally, the functionality of infant support 100 can be achieved by utilizing various configurations for reconfigurable support members 110 and 130. First reconfigurable support member 100 is not required to be cylindrical in shape or have it ends extend beyond he periphery of body 120, ad disclosed. A variety of shapes, e.g. rectangular, and dimensions for support member 110 could be utilized. With respect to second reconfigurable support member 130, whereas three planar members are disclosed for support member 130, it is not required. Two planar members could be utilized to form the wedge configuration of second support member 130. Additionally, a wedge-shaped configuration is not required for support member 130. Rectangular configurations could be utilized. Further, the second support member need not be formed of planar members. Rather, the second support member could simply be flexible planar extension of body 120 and could be rolled into a cylindrical shape and secured. Similarly, first support member 120 could also be formed by rolling a flexible planar extension of body 120 into a cylindrical shape about bendable element 115.

A second and presently preferred embodiment is illustrated in FIGS. 6A, 6B, 6C, 7, 8A, 8B and 9. The reconfigurable infant support 200 includes a first reconfigurable support member or restraining portion 210, a body 220, and a second reconfigurable support member or restraint 230. First reconfigurable support member 210 is attached to body 220 at its first end 222 and second reconfigurable support member 230 is attached to body 220 at its second end 224.

Figure 6A:
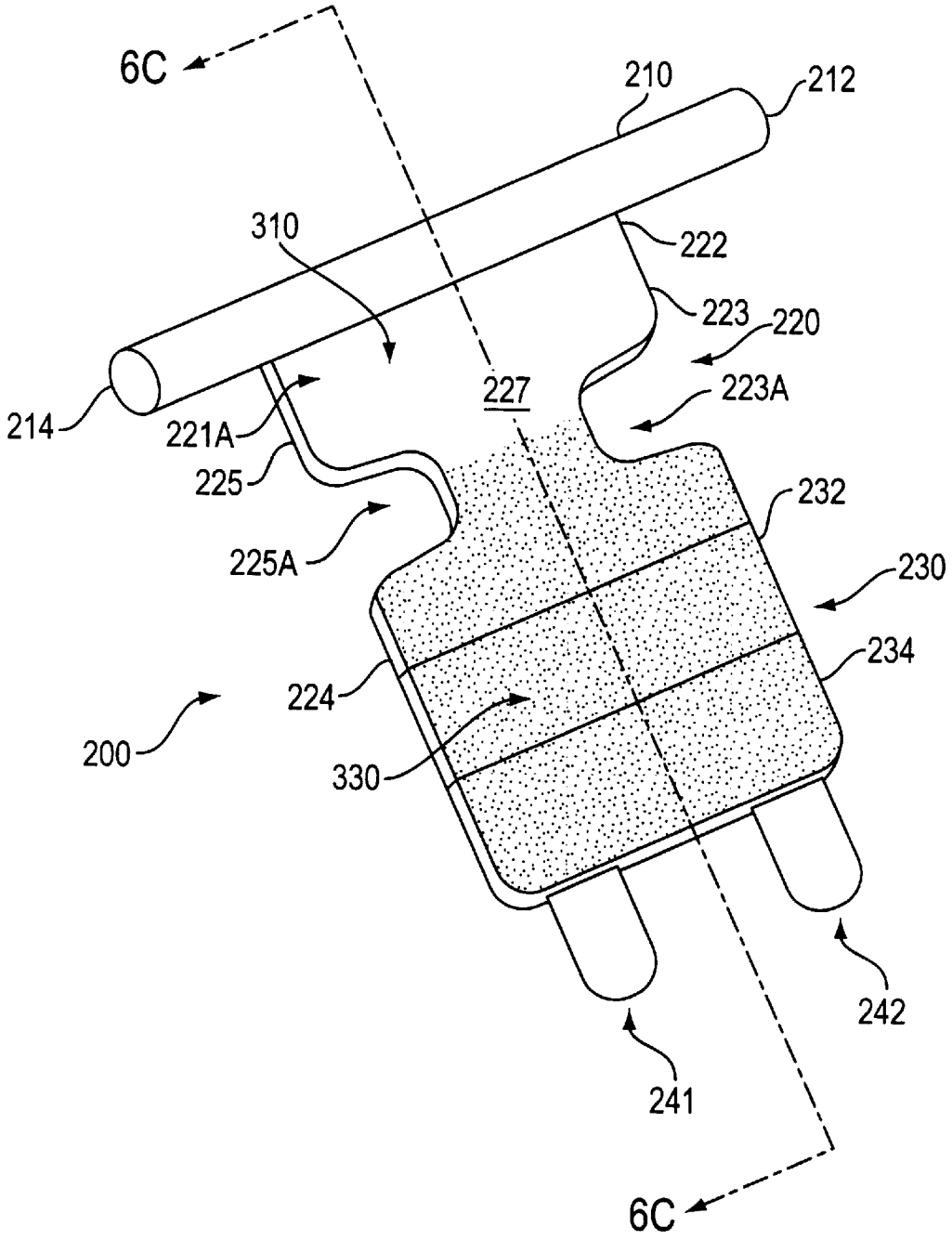
FIGS. 6A and 6B are top plan and bottom exploded views of a second embodiment of a reconfigurable infant support.
Figure 6B:
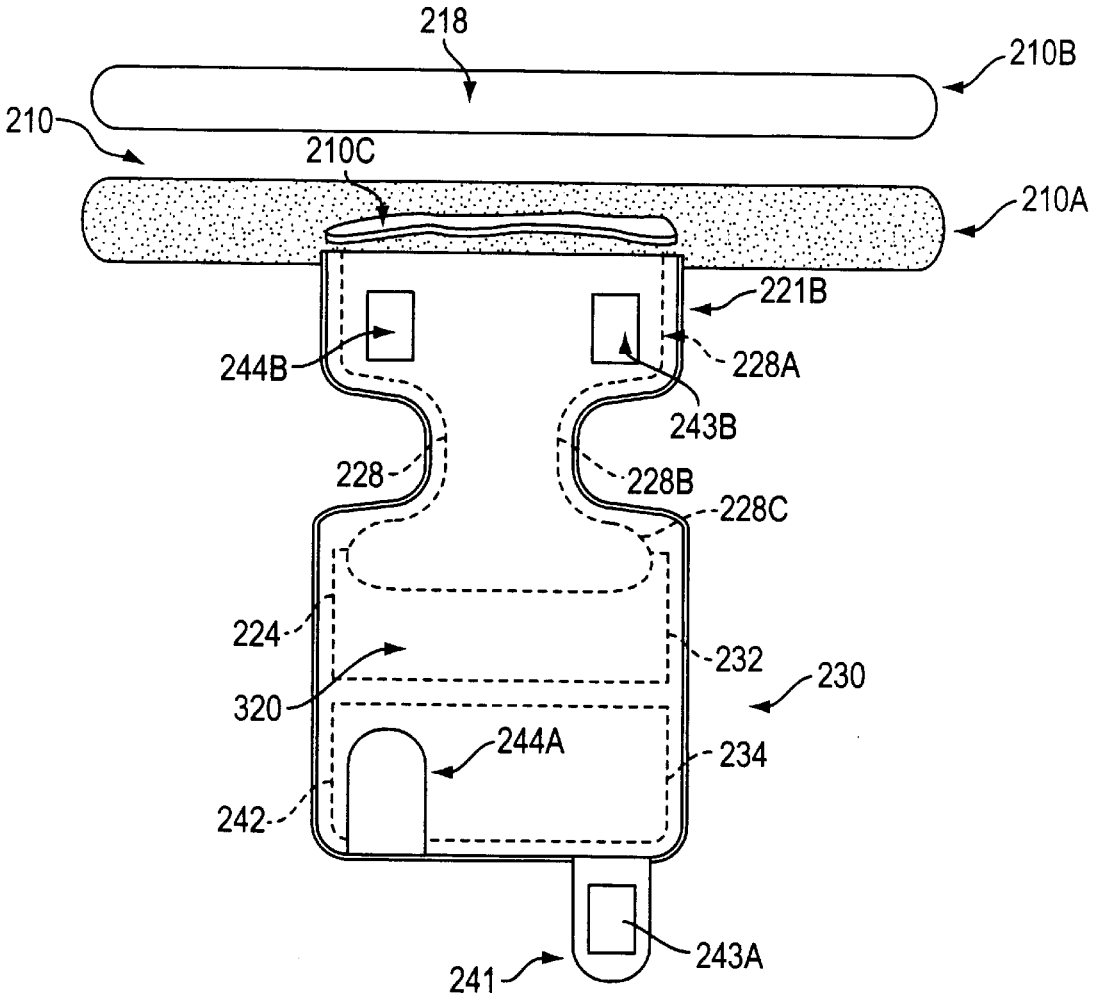

Body 220 has an upper surface 221A, lower surface 221B, and left and right lateral edges 223, 225 with notches 223A and 225A. Body 220 is formed of quilted fabric with a stiffening member, or batten 228 substantially contained within. The general planar shape of the batten 228 is illustrated in FIG. 6B by the dashed lines where the dashed lines are used to show that the batten 228 is contained within a quilted fabric. Batten 228 includes an upper portion 228A, a narrower, connection portion 228B, and a lower portion 228C. The lower end of lower part 228C extends beyond second end 224.

Support member 210 consists of a structural member 210B contained in an outer fabric portion 210A. FIG. 6B shows the support member 210 with the structural member 210B removed from the fabric portion 210A. Outer fabric portion 210A of support member 210 has a sleeve 210C for inserting structural member 210B into the outer fabric portion 210A. The sleeve can be opened and closed by using hook-and-loop fastener or any other means suitable for releasably containing structural member 210B within the fabric portion 210A. The removability of structural member 210B from the outer fabric portion 210A allows for a thorough cleaning of the outer fabric when the infant support 200 becomes soiled from use. Support member 210 is attached to the body 220 at a first end 222 by attaching a portion of the outer fabric portion 210A at a first end 222.

Structural member 210B consists of a bendable element 115, cushion 116, and the optional additional cushioning or shaping material 117(identical to the first embodiment), sealed in a preferably water resistant, fabric liner 218.

When infant support 200 is utilized to position an infant that is lying prone, the infant is placed on body 220 in child receiving area 227. When positioned in area 227, the infant can be securely positioned on the body with first support member 210 supporting the infant on one side and second support member 230, which will be discussed in detail below, supporting the infant on the opposing side. Body 220 may be cushioned to provide comfort for the infant.

When infant support 200 is utilized to support an infant that is seated in a child seat, body 220 serves as a lining for the seat. Left and right notches 225A and 223A are provided in body 220 so that when the infant support is used as a car seat lining, the support 200 does not block access to the shoulder belts of the car seat harness, and thereby permits passage of the harness through or around the body 220.

Figure 6C:
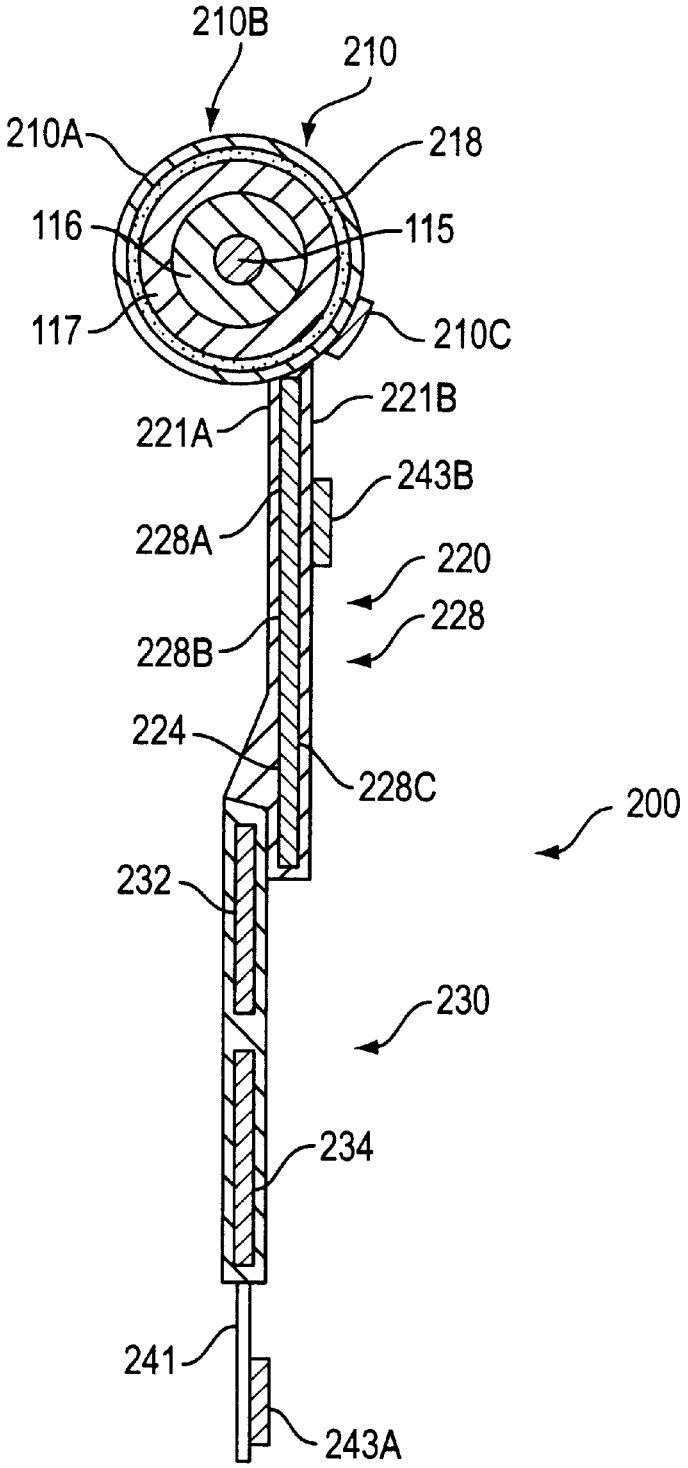
FIG. 6C is a cross-sectional view of the infant support taken along the line 6C—6C of FIG. 6A.

Second reconfigurable support member 230 is integrally formed with body 220 at a second end 224 of body 220. Second support member 230 is comprised of two similarly formed, individually positioned, planar members 232 and 234 contained within a quilted fabric, as indicated by the use of dashed lines in FIG. 6B. Planar members 232 and 234 are rectangularly shaped, relatively rigid, and are formed of polypropelene sheet. Second planar member 234 is disposed distal from second end 224 of body 220 while first planar member is disposed between second planar member 234 and second end 224 of body 220 such that a portion of the first planar member 232 lies between the lower end part of the batten 228C and the upper support surface 221A, as shown in FIGS. 6B and 6C. The planar members 232 and 234 have a width dimension that is slightly smaller than the width of body 220 and a thickness that is commensurate with the thickness of body 220. In the illustrated embodiment, the planar members have a nominal thickness of 0.08 inches (4 mm). As such, the planar members are able to be securely positioned within body 220. The planar members are positioned side-by-side within body 220 as can be seen in FIGS. 6B and 6C.

Figure 7:
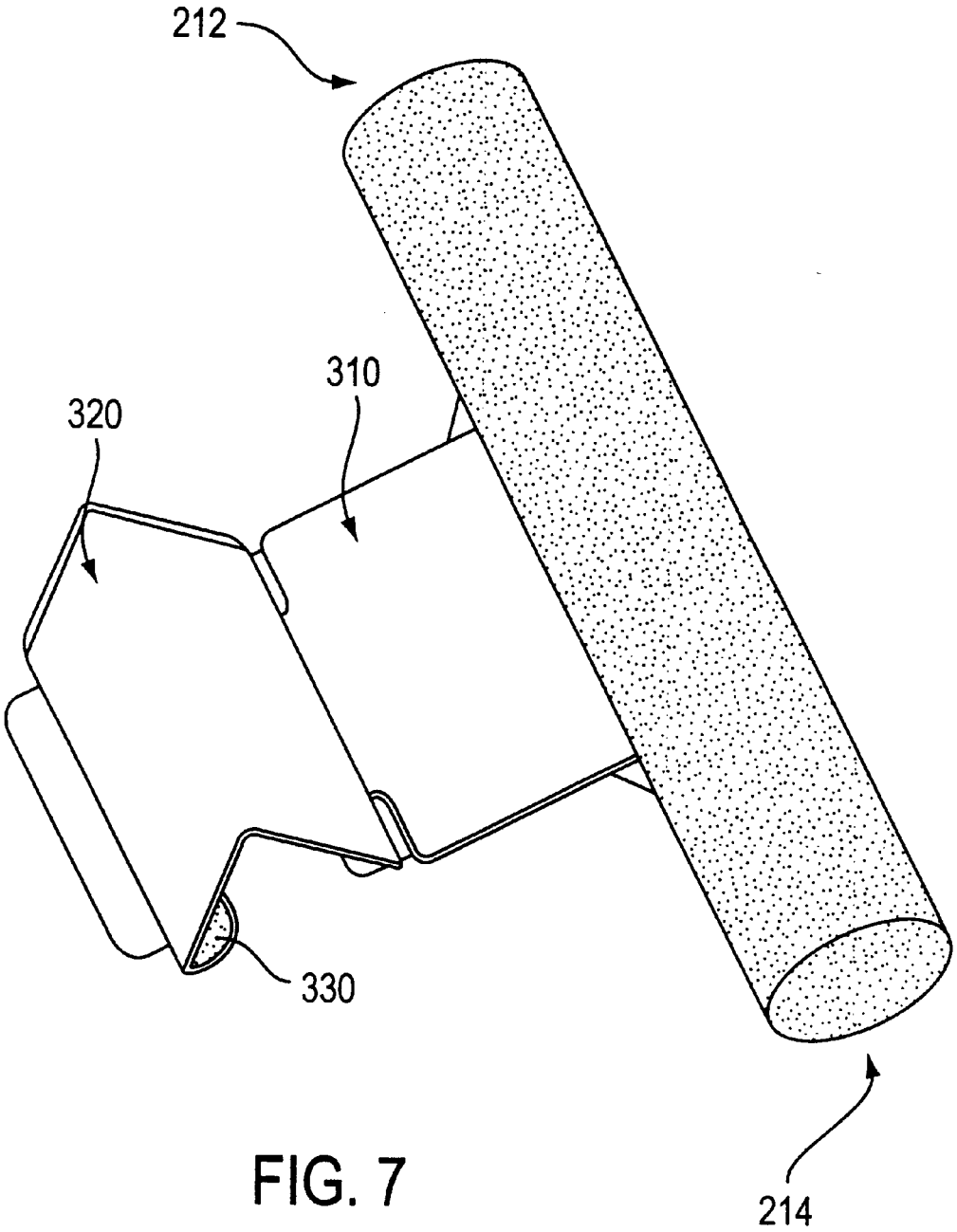
FIG. 7 is a top perspective view of the infant support of FIGS. 6A and 6B, with the second support member in a wedge shape configuration.
Figure 8A:
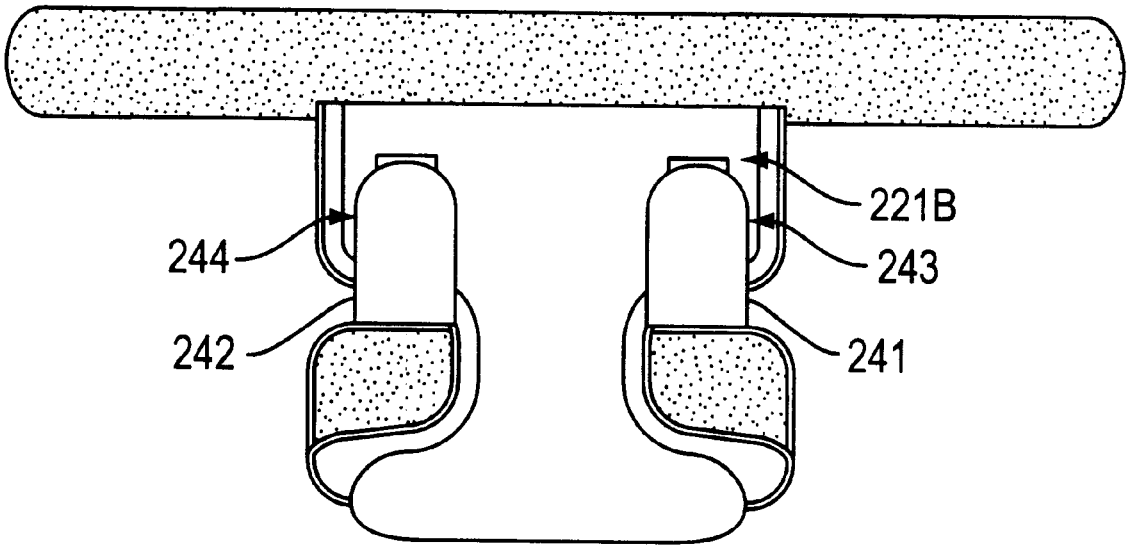
FIGS. 8A and 8B are bottom and side views of the infant support of FIG. 7.
Figure 8B:
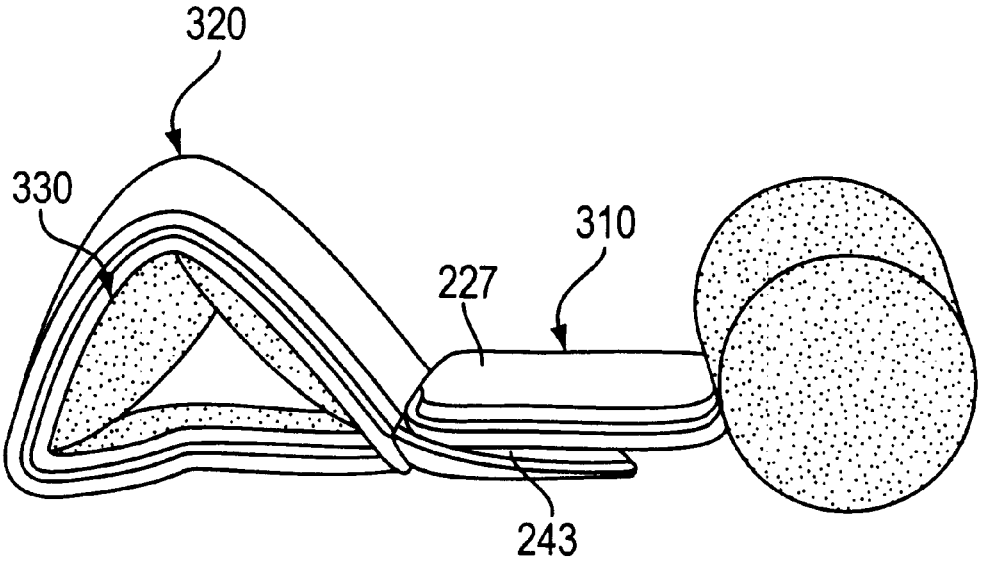

When infant support 200 is utilized to support an infant that is lying prone, support member 230 is folded into a first, wedge shape configuration as shown in FIGS. 7, 8A and 8B. When second reconfigurable support member 230 is formed into the wedge shape, support member 230 extends above the horizontal plane, or upper surface 221A, of body 220. To form the wedge shape, a user folds second planar member 234 in a first direction or over the upper support surface 221A such that the flexible tabs 241 and 242, attached to planar member 234, extend through the notches 223A and 225A. The lower portion 228C of the batten 228 serves as the base support of the wedge while first member 232 and second member 234 serve as angular supports.

Referring to FIG. 8A, the planar members are maintained in the wedge shape by attaching flexible tabs 241 and 242 to the lower support surface 221B of member 220. In the illustrated embodiment, the flexible tabs 241 and 242 are held to the body 220 using loop-and-hook fasteners 243 and 244. A first connector, or hook portion 243A is located on the surface of tab 241 shown in FIG. 6B. A similar first connector, or hook portion 244A is also located on tab 242 but is hidden from view in FIG. 6A for purposes of illustration. The corresponding second connectors, or loop portions 243B and 244B for the loop-and-hook fasteners for tabs 241 and 242 are located on lower support surface 221B. When the planar member 234 is folded over the upper support surface 221 A to form the angular supports of the wedge and the tabs extend through the notches 223A and 225A, the first connectors 243A and 244A will be positioned adjacent to the corresponding second connectors 243B and 244B located on the lower support surface 221B of the body 220 and the two tabs 241 and 242 may be mated with the lower support surface 221B to securely position the wedge with the body. Alternatively, fasteners 243 and 244 could be formed with snaps, buttons, magnets, zippers, or any other known fastener that provides for releasable connection of the wedge to the body 220. Finally, the releasable connection of the wedge can be achieved by using a pair of webbing restraints in conjunction with tabs 241 and 242.

Figure 9:
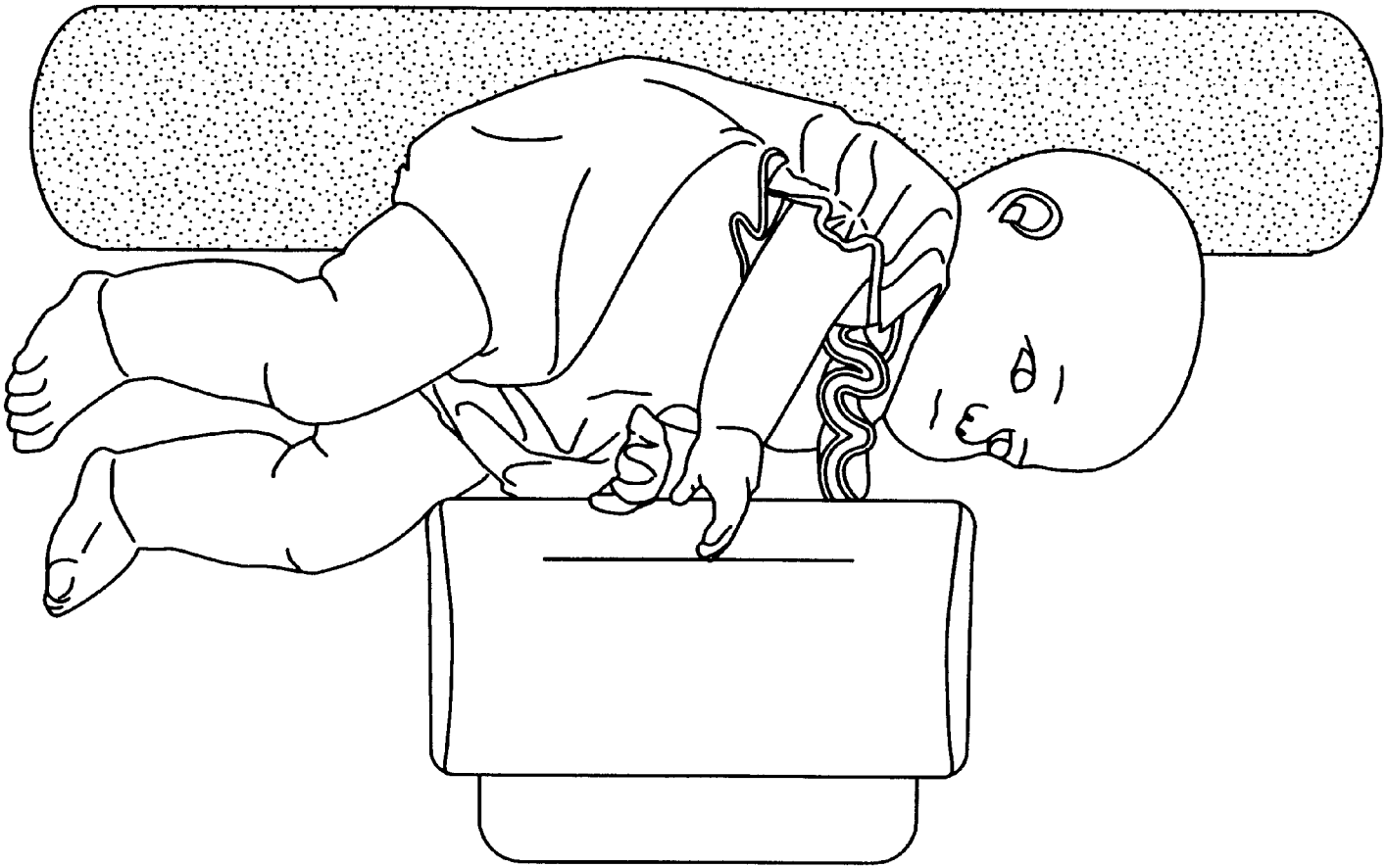
FIG. 9 is a top plan view of the reconfigurable infant support with an infant lying in a prone position.

By viewing FIG. 8B in conjunction with FIG. 9, one can see that the positioning of fasteners 243 and 244 on the horizontal lower support surface 221B will allow the weight of an infant lying prone to maintain the connection, thereby preventing inadvertent release of the first and second connectors 243A, 244A, 243B and 244B when the infant support 200 is utilized to support an infant lying in a prone position.

The presently preferred embodiment has two features that assist the user in properly assembling the wedge-shape configuration. First, by extending the lower portion of the batten 228C so that it overlaps a portion of the first planar member 232, a user cannot easily fold the first planar member in a second or misuse direction, since the overlapping portion of the lower portion of the batten 228C will resist such folding. Second, by using different visual attributes, a user is aware of whether he or she is properly assembling the wedge-shaped configuration. In the illustrated embodiment, a first colored fabric 310 is used for the portion of upper surface 221A nearest end 222. A second colored fabric 320, being complementary to first colored fabric 310, is used for the lower surface 221B of second support member 230. A dissimilar colored fabric 330, is used for all of the upper surface 221A portion of support member 230 and a portion of the upper surface 221A of the body 220. The first, second, and dissimilar colored fabrics 310, 320 and 330 give the user a visual confirmation that the wedge-shaped configuration has been properly assembled. When the wedge shape is properly assembled, the first and second colored fabrics 310 and 320 are disposed adjacent to each other, as shown in FIG. 7. Alternatively, this visual confirmation is given by dissimilar colored fabric 330 being hidden from view, as is evident in FIGS. 7 and 8B. If the user assembles the wedge-shape by folding the planar members 232 and 234 in an improper direction, a combination of the first and dissimilar colors 310 and 330 will appear, thus indicating to the user that he or she has improperly folded planar members 232 and 234. A variety of alternative means for providing first, second, and dissimilar visual attributes 310, 320 and 330, other than colored fabric, is realized. For example, different surface patterns or textures disposed on the lower and upper surfaces 221A and 221B of the body 220, or markers located on the lower and upper surfaces 221A and 221B can be used to provide visual confirmation during assembly of the wedge shape.

When infant support 200 is utilized to position an infant within a child's seat, planar members 232 and 234 of the second reconfigurable support member 230 are configured in a second configuration to lie coplanar with body 220 and substantially flush with upper surface 221 A. As such, second reconfigurable support member 230 is indistinguishable from body 220 and allows body 220 to be utilized to line the child's seat without any interference to the child occupant. Batten 228 provides a convenient means for positioning the infant support 200 as the batten 228 is capable of supporting member 210 and maintaining the position of the receiving area 227 during passage of the seat belt through or around the body portion when the infant is placed in the car seat.

Therefore, in operation, reconfigurable infant support 200 may be utilized to securely position an infant that is either lying flat in a prone position on a flat surface or an infant that is seated in a child seating apparatus. FIGS. 7, 8B and 9 depicts infant support 200 as utilized to support an infant lying prone on a flat surface. Second reconfigurable support member 230 is configured in the first, wedge-shaped configuration to securely position the child on the side opposing first reconfigurable support member 200. End portions 212 and 214 of support member 210 are shown in their extended positions in FIG. 7 but can be reconfigured so as to position these ends closer to the head and feet of the child occupant so that the child is positioned on three sides.

Several variations on the disclosed embodiments are contemplated. For example, the support members and body are all covered with cloth fabric material, however, water resistant materials, e.g. plastic, could be utilized to provide for ease in caring for and cleaning the cover. Additionally, the functionality of the infant support can be achieved by utilizing various configurations for the reconfigurable support members. The first reconfigurable support member is not required to be cylindrical in shape or have it ends extend beyond he periphery of the body as disclosed. A variety of shapes, e.g. rectangular, and dimensions for first support member could be utilized. With respect to the second reconfigurable support member, whereas two or three planar members are disclosed for the second support member, it is not required. Furthermore, a wedge shaped configuration is not required for second support member. Rectangular configurations could be utilized. Further, the second support member need not be formed of planar members. Rather, the second support member could simply be flexible planar extension of the body and could be rolled into a cylindrical shape and secured. Similarly, first support member could also be formed by rolling a flexible planar extension of the body into a cylindrical shape about the bendable material.

What is claimed:

1. A support for an infant, comprising:

a planar body having a first end, a second end, and an upper surface;

a first restraint mounted to said first end of said body, projecting above said upper surface of said body, and having a height sufficient to inhibit movement of an infant disposed on said upper surface toward said first end of said body; and a self-supporting second restraint pivotally mounted to said second end of said body and configurable in a first configuration in which said second restraint projects above said upper surface of said body to a height sufficient to inhibit movement of an infant disposed on said upper surface toward said second end of said body, and a second configuration in which said second restraint extends from, and is substantially flush with, said upper surface of said body.

2. The infant support of claim 1 further comprising an elongate bendable element disposed in said first restraint, said bendable element being positionable in different shapes and holding said restraint in said shapes.

3. The infant support of claim 2 wherein said bendable element is a malleable metal wire.

4. The infant support of claim 2 wherein said bendable element extends the full length of said first restraint.

5. The infant support of claim 2 wherein said bendable element is positioned along the longitudinal axis of said first restraint.

6. The infant support of claim 1 wherein said body has a predetermined width defined by opposed, spaced lateral edges and said first restraint has a length greater than the width of said body and thereby extends beyond the lateral edges of said body.

7. The infant support of claim 1 wherein said second restraint is comprised of first and second laterally-extending planar members, said first planar member being disposed proximal to said second end of said body and said second planar member being disposed distal from said second end of said body, said first and second planar members defining opposed upper faces of a wedge shape when said second restraint is disposed in said first configuration.

8. The infant support of claim 7 wherein said body has a lower surface, said second planar member has an upper surface, and further comprising a releasable connector having a mating first and second connector portion, said first connector portion being disposed on the lower surface of said body proximate said second end of said body and said second connector portion being disposed on the upper surface of said second planar member, said connector portions being coupled when said second restraint is positioned in said first configuration and retaining said second restraint in said first configuration.

9. The infant support of claim 8 further comprising a third laterally-extending planar member disposed between said first and second planar members, said third planar member forming a lower horizontal portion of said wedge shape when said second restraint is disposed in said first configuration.

10. The infant support of claim 7 wherein said second planar member has a lower surface and further comprising a releasable connector having a pair of first and second connector portions, said pair of first connector portions being disposed on a horizontal portion of said body and said second connector portion being disposed on the lower surface of said second planar member, said connector portions being coupled when said second restraint is positioned in said first configuration and retaining said second restraint in said first configuration.

11. The infant support of claim 7 further comprising a third laterally-extending member disposed beneath said upper surface and said wedge shape, said third laterally-extending member forming a lower horizontal portion of said wedge when said second restraint is disposed in said first configuration.

12. The infant support of claim 1 wherein said second restraint is pivotable in a first, intended direction from said second configuration to said first configuration and a second, opposite, misuse direction and wherein said planar body includes a stiffening member disposed beneath a portion of said planar body, said stiffening member resisting a pivoting motion in the misuse direction.

13. The infant support of claim 12 wherein said stiffening member is a portion of a batten.

14. The infant support of claim 1 wherein said support is adapted to be disposed on a seating surface of an infant's car seat having a restraining harness extending from a portion thereof for restraining an infant occupant of the seat and said second restraint is in said second configuration, said support further comprising an opening in said body portion through which the harness can pass.

15. The infant support of claim 15 wherein said opening is an aperture.

16. The infant support of claim 15 wherein said opening is a notch.

17. The infant support of claim 1 wherein said body includes a first visual attribute and said second restraint includes a second visual attribute, said second visual attribute being complementary to said first visual attribute and disposed adjacent to said first visual attribute when said second restraint is configured in said first configuration.

18. The infant support of claim 17 wherein said first visual attribute is a first color and said second visual attribute is a complementary color.

19. The support of claim 18 wherein said cylindrically shaped support cushion is reconfigurable.

20. The infant support of claim 1 wherein said body includes a first visual attribute and said second restraint includes a second visual attribute dissimilar to said first visual attribute, said second visual attribute being hidden from view when said second restraint is in said first configuration.

21. The infant support of claim 20 wherein said first visual attribute is a first color and said second visual attribute is a second color dissimilar to said first color.

22. The support of claim 20 wherein said cylindrically shaped support cushion contains a bendable metal wire encased in said support cushion.

23. The infant support of claim 1, wherein said second restraint includes a first surface and when said second restraint is reconfigured from said second configuration to said first configuration said first surface is pivoted so as to project above said upper surface of said body.

24. The infant support of claim 23, wherein said second restraint further includes a second surface pivotally coupled to said first surface and when said second restraint is reconfigured from said second configuration to said first configuration said second surface pivots relative to said first surface and said body upper surface.

25. The infant support of claim 24, wherein said second restraint first and second surfaces are defined by surfaces of first and second battens, respectively.

26. A support for a child, comprising:

a substantially planar body having a first end, an opposite, second end, and an upper support surface therebetween;

first means for restraining movement of a child placed on said upper surface toward said first end of said body, said first restraining means being fixed to said first end of said body; and second means for restraining movement of a child placed on said upper surface toward said second end of said body when said body is placed on a flat surface by projecting above said upper surface, said second restraining means being coupled to said second end of said body and being positionable in a substantially planar orientation.

27. The support of claim 22 wherein said first restraining means includes a cylindrical cushion and a bendable element encased in said cushion.

28. The support of claim 23 wherein said bendable element is formed of a metal wire.

29. The support of claim 23 wherein said bendable element extends the full length of said cylindrical cushion.

30. The support of claim 23 wherein said bendable element is positioned along the longitudinal axis of said cylindrical cushion.

31. The support of claim 22 wherein said body has a predetermined width defined by opposed, spaced lateral edges and said first restraining means has a length greater than the width of said body and extends transversely beyond the lateral edges of said body.

32. The support of claim 22 wherein said second restraining means includes first and second transversely extending, substantially rigid, planar members.

33. The support of claim 28 wherein said body has a lower surface, said second planar member has an upper surface, and further comprising a releasable connector having a mating first and second connector portion, said first connector portion being disposed on the lower surface of said body proximate said second end of said body and said second connector portion being disposed on the upper surface of said second planar member, said connector portions being coupled when said second restraining means is in said position projecting above said upper surface.

34. The infant support of claim 28 further comprising a third transversely-extending planar member disposed between said first and second planar members, said third planar member forming a lower horizontal support when said second restraining means is in said position projecting above said upper surface.

35. The support of claim 28 wherein said second planar member has a lower surface and further comprising a releasable connector having a mating first and second connector portion, said first connector portion being disposed on a horizontal portion of said body and said second connector portion being disposed on the lower surface of said second planar member, said connector portions being coupled when said second restraining means is in said position projecting above said upper surface.

36. The infant support of claim 28 further comprising a third transversely-extending planar member disposed beneath said upper surface and said wedge shape, said third transversely-extending planar member forming a lower horizontal support when said second restraining means is in said position projecting above said upper surface.

37. The child support of claim 22 wherein said support is adapted to be disposed on a seating surface of an child's car seat having a restraining harness extending from a portion thereof for restraining a child occupant of the seat and said second restraining means positioned in said planar orientation, said support further comprising an opening in said body portion through which the harness can pass.

38. The child support of claim 33 wherein said opening defines an aperture.

39. The child support of claim 33 wherein said opening is a notch.

40. An infant support, comprising:

a planar body having a first end, a second end and an upper surface;

a cylindrically shaped support cushion mounted to said first end of said body; and a self-supporting reconfigurable support integrally formed with and pivotable with respect to said body at a second end thereof, said reconfigurable support being configurable between a first configuration in which said reconfigurable support projects above said upper surface of said body to a height sufficient to inhibit movement of an infant disposed on said upper surface toward said second end of said body, and a second configuration in which said reconfigurable support is substantially flush with said upper surface of said body.

* * * * *